US008005410B2

(12) United States Patent
Wu

(10) Patent No.: US 8,005,410 B2
(45) Date of Patent: Aug. 23, 2011

(54) POLYIMIDE INTERMEDIATE TRANSFER COMPONENTS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 637 days.

(21) Appl. No.: 12/129,995

(22) Filed: May 30, 2008

(65) Prior Publication Data

US 2009/0297232 A1 Dec. 3, 2009

(51) Int. Cl.
*G03G 15/01* (2006.01)

(52) U.S. Cl. ..... 399/302

(58) Field of Classification Search ..... 399/302, 399/308, 297, 298

See application file for complete search history.

(56) References Cited

U.S. PATENT DOCUMENTS

| | | | | |
|---|---|---|---|---|
| 4,426,435 | A * | 1/1984 | Oka | 430/132 |
| 6,397,034 | B1 * | 5/2002 | Tarnawskyj et al. | 399/308 |
| 6,602,156 | B2 | 8/2003 | Schlueter, Jr. | |
| 7,031,647 | B2 | 4/2006 | Mishra et al. | |
| 7,130,569 | B2 | 10/2006 | Goodman et al. | |
| 7,139,519 | B2 | 11/2006 | Darcy, III et al. | |
| 7,280,791 | B2 | 10/2007 | Goodman et al. | |
| 2006/0127138 | A1 * | 6/2006 | Egawa | 399/297 |
| 2006/0257769 | A1 * | 11/2006 | Wu et al. | 430/58.35 |

OTHER PUBLICATIONS

VTEC PI Polyimide Parts and Shapes (1999-2005 Richard Blaine International, Inc.).*

* cited by examiner

*Primary Examiner* — David Gray
*Assistant Examiner* — Billy J Lactaoen
(74) *Attorney, Agent, or Firm* — Oliff & Berridge, PLC

(57) ABSTRACT

An intermediate transfer belt that includes a thermosetting polyimide and a conductive component, and where the polyimide is rapidly cured.

10 Claims, 1 Drawing Sheet

POLYIMIDE INTERMEDIATE TRANSFER COMPONENTS

BACKGROUND

Figure 1:
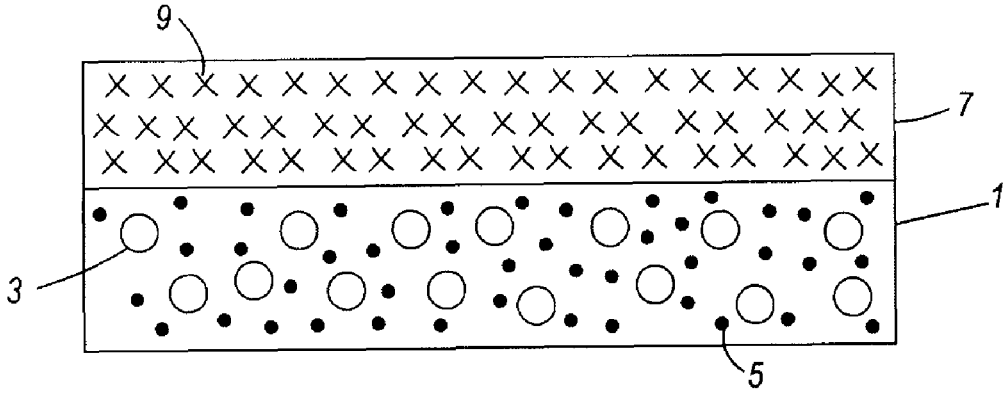

Disclosed are intermediate transfer members, and more specifically, intermediate transfer members useful in transferring a developed image in an electrostatographic, for example xerographic, including digital, image on image, and the like, machines or apparatuses. In embodiments, there are selected intermediate transfer members comprising a layer or substrate comprising a thermosetting polyimide, and more specifically, an intermediate transfer belt comprised of a conductive component like carbon black, a polyaniline, a carbon nanotube, and the like, or mixtures thereof dispersed in a thermosetting polyimide, which polyimide is cured at low temperatures, such as less than about 290° C., and more specifically, from about 180 to about 260° C., from about 180 to about 215° C., from about 195 to about 225° C., from about 200 to about 250° C., from about 200 to about 210° C., from about 200 to about 205° C. over a short period of time, such as for example, from about 10 to about 120 minutes, and from about 20 to about 60 minutes. The polyimide is available as VTEC™ PI 1388 from Richard Blaine International, Incorporated, Reading, Pa. Conventional thermosetting polyimides, such as KAPTON® polyimides available from E.I. DuPont, are usually cured at high temperatures, such as over 300° C., and more specifically, from about 305 to about 350° C. over a period of time, such as from about 30 to about 240 minutes, from about 25 to about 45 minutes, from about 20 to about 40 minutes, from about 20 to about 100 minutes, from about 15 to about 25 minutes, and from about 60 to about 120 minutes.

A number of advantages are associated with the intermediate transfer member of the present disclosure such as excellent dimensional stability, lower surface friction, and less humidity sensitivity; low temperature and fast curing when compared with the known KAPTON® polyimide member; and more specifically, the polyimide containing intermediate transfer belt possesses in embodiments a surface resistivity of from about $10^9$ to about $10^{13}$ ohm/sq (as measured by a High Resistivity Meter under 1,000 volts), a tensile strength of from about 150 to about 400 MPa (as measured by an Instron Tensile Tester, ASTM D-882-91, Method A), and the intermediate transfer members of the present disclosure are weldable while a number of the prior art polyimide containing transfer members are difficult or usually cannot be properly welded. Also, it is believed that a number of the known polyimide transfer belts are free of curing, or not readily curable especially at temperatures below about 300° C.; and should the prior art thermosetting polyimide ITB be even partially cured at less than 300° C., the tensile strength is usually too weak to permit such known polyimides to be used as a functional ITB.

While not being desired to be limited by theory, it is believed that the disclosed polyimide is prepared by the reaction of an aromatic diamine with an aromatic dicarboxylic acid, where either amine or carboxylic acid or both contains a C═C substituting group. Thus, two reactions occur during the less than about 300° C. cure (1) nominal but incomplete imidization; and (2) free radical polymerization of the substituting C═C groups, which permits a high ITB tensile strength. In contrast, for the known polyimides, there exists only a single imidization during cure, and no other crosslinking such as free radical polymerization thus a number of the known polyimide ITB require curing above 300° C. in order to obtain a high tensile strength.

In a typical electrostatographic reproducing apparatus, a light image of an original to be copied is recorded in the form of an electrostatic latent image upon a photosensitive member, and the latent image is subsequently rendered visible by the application of electroscopic thermoplastic resin particles and colorant, which are commonly referred to as toner. Generally, the electrostatic latent image is developed by bringing a developer mixture into contact therewith. The developer mixture can comprise a dry developer mixture, which usually comprises carrier granules having toner particles adhering triboelectrically thereto, or a liquid developer material, which may include a liquid carrier having toner particles, dispersed therein. The developer material is advanced into contact with the electrostatic latent image, and the toner particles are deposited thereon in image configuration. Subsequently, the developed image is transferred to a copy sheet. It is advantageous to transfer the developed image to a coated intermediate transfer web, belt or component, and subsequently transfer with very high transfer efficiency the developed image from the intermediate transfer member to a permanent substrate. The toner image is subsequently usually fixed or fused upon a support, which may be the photosensitive member itself, or other support sheet such as plain paper.

In electrostatographic printing machines wherein the toner image is electrostatically transferred by a potential difference between the imaging member and the intermediate transfer member, the transfer of the toner particles to the intermediate transfer member and the retention thereof should be substantially complete so that the image ultimately transferred to the image receiving substrate will have a high resolution. Substantially 100 percent toner transfer occurs when most or all of the toner particles comprising the image are transferred, and little residual toner remains on the surface from which the image was transferred.

Intermediate transfer members allow for positive attributes, such as enabling high throughput at modest process speeds, improving registration of the final color toner image in color systems using synchronous development of one or more component colors using one or more transfer stations, and increasing the range of final substrates that can be used. However, a disadvantage of using an intermediate transfer member is that a plurality of transfer steps is required allowing for the possibility of charge exchange occurring between toner particles and the transfer member which ultimately can lead to less than complete toner transfer. The result is low-resolution images on the image receiving substrate and image deterioration. When the image is in color, the image can additionally suffer from color shifting and color deterioration. In addition, the incorporation of charging agents in liquid developers, although providing acceptable quality images and acceptable resolution due to improved charging of the toner, can exacerbate the problem of charge exchange between the toner and the intermediate transfer member.

In embodiments, the resistivity of the intermediate transfer member is within a range to allow for sufficient transfer. It is also desired that the intermediate transfer member have a controlled resistivity, wherein the resistivity is virtually unaffected by changes in humidity, temperature, bias field, and operating time. In addition, a controlled resistivity is of value so that a bias field can be established for electrostatic transfer. Also, it is of value that the intermediate transfer member not be too conductive as air breakdown can possibly occur.

Attempts at controlling the resistivity of intermediate transfer members have been accomplished by, for example, adding conductive fillers such as ionic additives and/or carbon black to the outer layer. For example, U.S. Pat. No. 6,397,034 discloses the use of fluorinate carbon filler in a polyimide intermediate transfer member layer. However, there are problems associated with the use of such additives. In particular, undissolved particles frequently bloom or migrate to the surface of the polymer. and cause an imperfection in the polymer. This leads to nonuniform resistivity, which in turn causes poor antistatic properties and poor mechanical strength. The ionic additives on the surface may interfere with toner release. Furthermore, bubbles may appear in the conductive polymer, some of which can only be seen with the aid of a microscope, others of which are large enough to be observed with the naked eye. These bubbles provide the same kind of difficulty as the undissolved particles in the polymer, namely poor or nonuniform electrical properties and poor mechanical properties.

In addition, the ionic additives themselves are sensitive to changes in temperature, humidity, and operating time. These sensitivities often limit the resistivity range. For example, the resistivity usually decreases by up to two orders of magnitude or more as the humidity increases from about 20 percent to 80 percent relative humidity. This effect limits the operational or process latitude.

Moreover, ion transfer can also occur in these systems. The transfer of ions leads to charge exchanges and insufficient transfers, which in turn causes low image resolution and image deterioration, thereby adversely affecting the copy quality. In color systems, additional adverse results include color shifting and color deterioration. Ion transfer also increases the resistivity of the polymer member after repetitive use. This can limit the process and operational latitude, and eventually the ion-filled polymer member will be unusable.

The use of polyaniline filler contained in a polyimide has been disclosed in U.S. Pat. No. 6,602,156. More specifically, this patent discloses a polyaniline filled polyimide puzzle cut seamed belt. The manufacture of the puzzle cut seamed belt is usually labor intensive and costly, and the puzzle cut seam, in embodiments, is sometimes weak. The manufacturing process for a puzzle cut seamed belt requires an extended high temperature and a high humidity conditioning step. For the conditioning step, each individual belt is rough cut, rolled up, and placed in a conditioning chamber that is environmentally controlled at 45° C. and 85 percent relative humidity, for approximately 20 hours. Another 3 hours are required to bring the belt back down to ambient conditioning to prevent condensation and watermarks before it can be removed from the conditioning chamber. This conditioning operation is selected to result in a belt with an appropriate resistivity range for use in a color printer. The conditioning step also involves that the sheets of the belt material be cut roughly to size prior to conditioning. This renders it difficult to automate the manufacturing process for puzzle cut seamed belts. Without the 24 hour high temperature and high humidity conditioning step, the belt's electrical properties and hence image quality will not be stable for several months.

Small circumference intermediate transfer belts can be obtained by extrusion or spin casting. However, extrusion and spin casting are not cost effective for belts requiring larger circumferences. Larger circumference belts are typically selected for use in color xerographic tandem engine architecture machines.

It is desired to provide a weldable intermediate transfer belt, which has improved transfer ability and permits improved copy quality. It is also desired to provide a weldable intermediate transfer belt that may not, but could, have puzzle cut seams, but instead, has a weldable seam, thereby providing a belt that can be manufactured without labor intensive steps as manually piecing together the puzzle cut seam with fingers, and without the lengthy high temperature and high humidity conditioning steps. It is also desired to provide a higher circumference weldable belt for color machines.

REFERENCES

Illustrated in U.S. Pat. No. 7,130,569, the disclosure of which is totally incorporated herein by reference, is a weldable intermediate transfer belt comprising a substrate comprising a homogeneous composition comprising a polyaniline in an amount of from about 2 to about 25 percent by weight of total solids, and a thermoplastic polyimide present in an amount of from about 75 to about 98 percent by weight of total solids, wherein the polyaniline has a particle size of from about 0.5 to about 5.0 microns.

Illustrated in U.S. Pat. No. 7,280,791, the disclosure of which is totally incorporated herein by reference, is a weldable intermediate transfer belt comprising a substrate comprising a homogeneous composition comprising polyaniline in an amount of from about 2 to about 25 percent by weight of total solids, and thermoplastic polyimide in an amount of from about 75 to about 98 percent by weight of total solids, wherein the polyaniline has a particle size of from about 0.5 to about 5.0 microns;

Illustrated in U.S. Pat. No. 7,031,647, the disclosure of which is totally incorporated herein by reference, is an image forming apparatus for forming images on a recording medium comprising:

a charge-retentive surface to receive an electrostatic latent image thereon;

a development component to apply toner to the charge-retentive surface to develop the electrostatic latent image to form a developed toner image on the charge retentive surface;

an intermediate transfer member to transfer the developed toner image from the charge retentive surface to a copy substrate, wherein the intermediate transfer member comprises a substrate comprising a first binder and lignin sulfonic acid doped polyaniline dispersion; and a fixing component to fuse the developed toner image to the copy substrate.

Illustrated in U.S. Pat. No. 7,139,519, the disclosure of which is totally incorporated herein by reference, is an intermediate transfer belt, comprising:

a belt substrate comprising primarily at least one polyimide polymer; and a welded seam.

SUMMARY

In embodiments, there is disclosed an intermediate transfer belt comprised of a substrate comprising a polyimide and a conductive component, wherein the polyimide is cured at the temperatures illustrated herein, such as from about 175° C. to about 290° C. over a period of time of from about 10 minutes to about 120 minutes; a weldable intermediate transfer media comprised of a polyimide and a conductive component, and wherein the polyimide is cured at from about 150° C. to about 250° C. for a period of time of about 10 to about 60 minutes; a transfer media comprised of a substrate comprising a polyimide and a conductive component wherein the polyimide is cured at a temperature of from about 195° C. to about 225° C. over a period of time of from about 20 minutes to about 100 minutes; and an apparatus for forming images on a recording medium comprising a charge-retentive surface to receive an electrostatic latent image thereon;

a development component to apply toner to the charge-retentive surface to develop the electrostatic latent image, and to form a developed image on said charge retentive surface;

an intermediate transfer belt to transfer the developed image from the charge retentive surface to a substrate, wherein the intermediate transfer belt comprises a substrate of a thermosetting crosslinked polyimide and a conductive component, and wherein the polyimide is cured at a temperature of from about 195° C. to about 250° C. for a period of time of about 10 to about 60 minutes, and a fixing component.

In addition, the present disclosure provides, in embodiments, an apparatus for forming images on a recording medium comprising a charge-retentive surface to receive an electrostatic latent image thereon; a development component to apply toner to the charge-retentive surface to develop the electrostatic latent image, and to form a developed image on the charge retentive surface; a weldable intermediate transfer belt for accepting the transfer of the developed image thereto from the charge retentive surface to a substrate; and a fixing component.

FIGURE

The following FIGURE is provided to further illustrate the intermediate transfer members disclosed herein.

FIG. 1 illustrates an exemplary embodiment of an intermediate transfer member of the present disclosure.

EMBODIMENTS

In FIG. 1 there is illustrated an intermediate transfer member comprising layer 1 of a mixture of thermosetting polyimides 3, and conductive components 5, and a release layer 7 containing polymer release components 9.

Examples of low temperature and fast cured polyimide polymers selected for the ITB include VTEC™ PI 1388, 080-051, 851, 302, 203, 201 and PETI-5, all available from Richard Blaine International, Incorporated, Reading, Pa. These thermosetting polyimides are cured at low temperatures, as compared to a number or related prior art ITB, and more specifically, from about 180 to about 260° C. over a short period of time, such as from about 10 to about 120 minutes, and from about 20 to about 60 minutes; possess a number average molecular weight of from about 5,000 to about 500,000, or from about 10,000 to about 100,000, and a weight average molecular weight of from about 50,000 to about 5,000,000, or from about 100,000 to about 1,000,000. The intermediate transfer member has a thickness of, for example, from about 30 to about 200 or from about 50 to about 150 microns, and the weight percent of the thermosetting polyimide in the intermediate transfer member is from about 60 to about 99 or from about 80 to about 95.

Examples of further components for the intermediate transfer member include conductive components and polymers, such as carbon fillers, polyanilines, and mixtures thereof.

The intermediate transfer members are in embodiments weldable, that is the seam of the polyimide belt is weldable, and more specifically, may be ultrasonically welded to produce a seam that is as strong as, or stronger than the polyimide material itself. In addition, the disclosed weldable polyimide belts permit the avoidance of the use of carbon blacks and other fillers, although in embodiments, carbon black or other fillers can be added.

In a multi-imaging system, each image being transferred is formed on the imaging drum by an image forming station, wherein each of these images is then developed at a developing station, and transferred to the intermediate transfer member. The images may be formed on the photoconductor and developed sequentially, and then transferred to the intermediate transfer member. In an alternative method, each image may be formed on the photoconductor or photoreceptor drum, developed, and transferred in registration to the intermediate transfer member. In an embodiment, the multi-image system is a color copying system, wherein each color of an image being copied is formed on the photoreceptor drum, developed, and transferred to the intermediate transfer member.

The intermediate transfer member may be in the form of a sheet, web or belt, or in the form of a roller or other suitable form. The intermediate transfer member can be a single layer wherein the substrate comprises the polyaniline or carbon filled polyimide, or it can be of several layers, such as from 2 to about 5 layers.

After the toner latent image has been transferred from the photoreceptor drum to the intermediate transfer member, the intermediate transfer member may be contacted under heat and pressure to an image receiving substrate such as paper. The toner image on the intermediate transfer member is then transferred and fixed, in image configuration, to a substrate such as paper.

The polyaniline or carbon filled polyimide substrate can comprise a polyimide having a suitable high tensile modulus, and in embodiments, the polyimide is one that is capable of becoming a conductive film upon the addition of electrically conductive particles. In embodiments, the polyimide is one having a high tensile modulus, as illustrated herein since, for example, the high tensile modulus optimizes the film stretch registration and transfer conformance.

The intermediate transfer member comprises in embodiments a polyaniline filler in the thermosetting polyimide polymer. The use of the polyaniline dispenses with the need for nanoparticles and/or carbon black and/or other fillers normally necessary in intermediate transfer members to obtain the desired resistivity. Although not being desired to be limited by theory, additional fillers can be avoided, since the method of reaction between the polyaniline and the polyimide results in the present polyaniline-filled polyimide weldable belt as a single, homogeneous material. Homogeneous refers, for example, to the entire layer having the same average composition as opposed to a device that has distinct layers such as a supporting substrate and a separate conducting layer. However, in embodiments, a filler, such as carbon black, may be added to the belt dispersion.

The thermosetting polyimide is present in the polyaniline filled polyimide substrate in an amount, for example, of from about 75 to about 98 percent by weight of total solids, or from about 86 to about 95, or from about 90 to about 92 percent by weight of total solids. Total solids include the total percentage by weight (equal to 100 percent) of polyimide, polyaniline, any additional fillers, and any additives in the layer. The polyaniline is present in the polyimide in, for example, an amount of from about 2 to about 25, from about 5 to about 14, or from about 8 to about 10 percent.

In embodiments, the polyaniline has a relatively small particle size of from about 0.5 to about 5, from about 1.1 to about 2.3, from about 1.2 to about 2.0, from about 1.5 to about 1.9, or about 1.7 microns. In order to achieve this small particle size, the polyaniline filler may need to be subjected to a grinding step. Polyaniline fillers can be purchased commercially from Panipol Oy, Finland, and other vendors.

In embodiments, an additional filler, other than a polyaniline, can be included in the intermediate transfer member dispersion, such as a carbon filler, such as carbon black, graphite, or other carbon fillers, can be used. The amount of carbon black filler in the polyaniline filled polyimide weldable substrate is, for example, from about 1 to about 20, or from about 2 to about 10, or from about 3 to about 5 percent by weight of total solids.

The surface resistivity of the intermediate transfer member is, for example, from about $10^9$ to about $10^{13}$ or from about $10^{10}$ to about $10^{12}$ ohm/sq. The sheet resistivity of the intermediate transfer weldable member is from about $10^9$ to about $10^{13}$ or from about $10^{10}$ to about $10^{12}$ ohm/sq.

The intermediate transfer member can be of any suitable configuration. Examples of suitable configurations include a sheet, a film, a web, a foil, a strip, a coil, a cylinder, a drum, an endless strip, a circular disc, a belt including an endless belt, an endless seamed flexible belt, and an endless seamed flexible belt. The circumference of the component in a film or belt configuration of from 1 to 2, or more layers is from about 250 to about 2,500, from about 1,500 to about 2,500, or from about 2,000 to about 2,200 millimeters. The width of the film or belt is from about 100 to about 1,000, from about 200 to about 500, or from about 300 to about 400 millimeters.

Roughness can be characterized by microgloss wherein a rougher surface has a lower microgloss than a smoother surface. The microgloss values of the weldable polyaniline filled polyimide intermediate transfer belt are, for example, from about 85 to about 110, from about 90 to about 105, or from about 93 to about 98 gloss units. These measurements were taken at an 85° angle. The present disclosed belt, in embodiments, achieved the desired high gloss level without the need for additional fillers. Microgloss is a measure of the amount of light reflected from the surface at a specific angle, and can be measured with commercial equipment such as the Micro-TR1-gloss instrument from BYK Gardner.

The weldable belt, in embodiments, has a smooth seam with the advantage that blade cleaning over the smooth surface is improved as compared to a bumpy surface or bumpy seam.

Specific embodiments will now be described in detail. These examples are intended to be illustrative, and the disclosure is not limited to the materials, conditions, or process parameters set forth in these embodiments. All parts are percentages by weight of total solids unless otherwise indicated.

EXAMPLE I

A polyaniline intermediate transfer belt (ITB) dispersion was prepared as follows. One gram of a lignosulfonic acid grafted polyaniline shown as below, 30 grams of the low temperature and fast cured polyimide, VTEC™ PI 1388, 30 weight percent in N-methyl-2-pyrrolidone (NMP) available from Richard Blaine International, Incorporated, Reading, Pa., and 19 grams of NMP were mixed, and then milled with 300 grams of 2 millimeter stainless shots at 800 rpm for 3 hours via attritor. The resulting dispersion was isolated, and then coated on a glass plate. The resulting film was cured on the glass plate first at 100° C. for 20 minutes, and at 204° C. for an additional 20 minutes. The cured ITB on the glass plate was then immersed into water for 18 hours, and then automatically released from the glass. The resulting free standing ITB film with a formulation of polyimide/polyaniline (ratio of 90/10) and had a thickness of 50 microns.

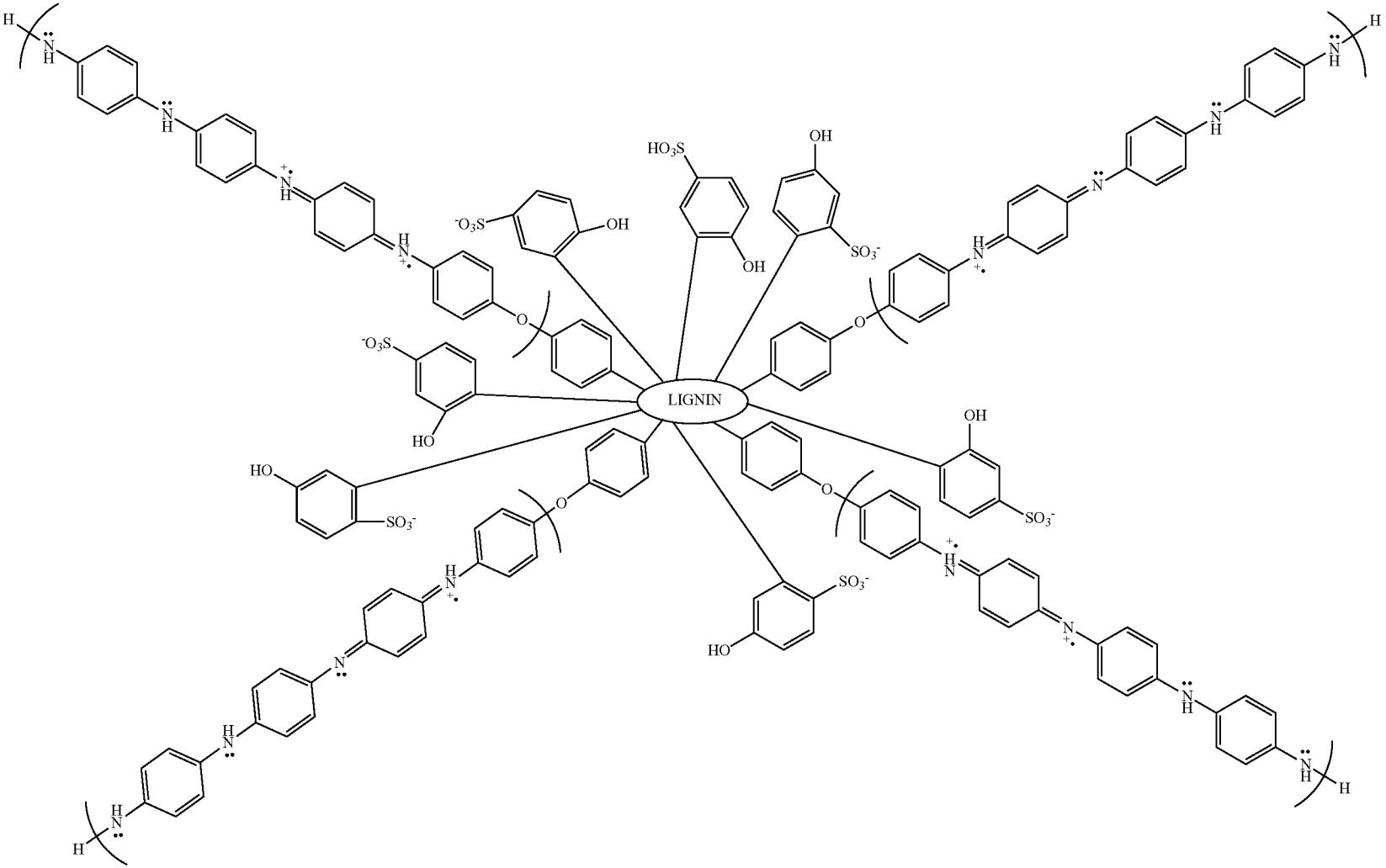
LIGNIN

EXAMPLE II

A carbon black intermediate transfer belt (ITB) dispersion was prepared as follows. 0.6 Gram of a carbon black, VULCAN® XC72R (obtained from Cabot, BET ~254 $m^2$/gram), 31.3 grams of the low temperature and fast cured polyimide, VTEC™ PI 1388, 30 weight percent in N-methyl-2-pyrrolidone (NMP), available from Richard Blaine International, Incorporated, Reading, Pa., and 18.1 grams of NMP were mixed, and then milled with 300 grams of 2 millimeter stainless shots at 800 rpm for 3 hours via attritor. The resulting dispersion was isolated, and then coated on a glass plate. The film was cured on the glass plate first at 100° C. for 20 minutes, and at 204° C. for an additional 20 minutes. The cured ITB on the glass plate was then immersed into water for 18 hours, and automatically released from the glass. The resulting free standing ITB film comprised of a polyimide/carbon black (ratio 94/6) had a thickness of 50 microns.

Surface Resistivity Measurement

The free standing films of Examples I and II were measured for surface resistivity (under 1,000V, averaging four measurements at varying spots, 72° F./22 percent room humidity) using a High Resistivity Meter (Hiresta-Up MCP-HT450 from Mitsubishi Chemical Corp.), and the results are shown in Table 1.

TABLE 1

| | Surface Resistivity (ohm/sq) |
|---|---|
| Example I | $2.5 \times 10^{12}$ |
| Example II | $3.7 \times 10^{10}$ |

Functional ITB films with nominal surface resistivity range were obtained from the disclosed low temperature and fast cured polyimide dispersed with either polyaniline (Example I) or carbon black (Example II).

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An intermediate transfer belt comprised of a substrate comprising a dispersion of a lignosulfonic acid grafted polyaniline, and a thermosetting polyimide present in an amount of from about 80 to about 95 weight percent with a number average molecular weight of from about 10,000 to about 100,000 and a weight average molecular weight of from about 100,000 to about 1,000,000, wherein the intermediate transfer belt has a surface resistivity of from about $10^{10}$ to about $10^{12}$ ohm/sq, a microgloss value of from about 85 to about 100 gloss units, and a tensile strength of from about 150 to about 400 Mega Pascal.

2. An intermediate transfer belt in accordance with claim 1 further containing a carbon filler present in an amount of from about 2 to about 30 percent by weight based on the weight of total solids.

3. A transfer belt in accordance with claim 2 wherein said carbon filler is present in an amount of from about 4 to about 15 percent by weight of total solids.

4. A transfer belt in accordance with claim 1 wherein said polyimide is crosslinked.

5. A weldable intermediate transfer consisting of a dispersion of a lignosulfonic acid grafted polyaniline with a particle size diameter of from about 0.5 to about 5 microns; and a thermosetting polyimide present in an amount of from about 80 to about 95 weight percent with a number average molecular weight of from about 10,000 to about 100,000 and a weight average molecular weight of from about 100,000 to about 1,000,000, wherein the intermediate transfer belt has a surface resistivity of from about $10^{10}$ to about $10^{12}$ ohm/sq, a microgloss value of from about 85 to about 100 gloss units, and a tensile strength of from about 150 to about 400 Pascal, and further comprising an outer release layer positioned on said substrate.

6. A transfer belt in accordance with claim 1 further comprising an outer release layer positioned on said substrate.

7. A transfer belt in accordance with claim 6 wherein said release layer comprises poly(vinyl chloride).

8. A transfer belt in accordance with claim 1 wherein said intermediate transfer belt has a circumference of from about 250 to about 2,500 millimeters.

9. An apparatus for forming images on a recording medium comprising a charge-retentive surface to receive an electrostatic latent image thereon;

a development component to apply toner to said charge-retentive surface to develop said electrostatic latent image, and to form a developed image on said charge retentive surface;

an intermediate transfer belt consisting essentially of a dispersion of a lignosulfonic acid grafted polyaniline and a thermosetting crosslinked polyimide present in an amount of from about 80 to about 95 weight percent with a number average molecular weight of from about 10,000 to about 100,000 and a weight average molecular weight of from about 100,000 to about 1,000,000, wherein the intermediate transfer belt has a surface resistivity of from about $10^{10}$ to about $10^{12}$ ohm/sq, a microgloss value of from about 85 to about 100 gloss units, and a tensile strength of from about 150 to about 400 Mega Pascal, and a fixing component.

10. An apparatus in accordance with claim 9 wherein the charge retentive surface is a photoconductor.

* * * * *